United States Patent [19]

Karas et al.

[11] 4,264,017

[45] Apr. 28, 1981

[54] CONTAINER SHAPE

[75] Inventors: Richard J. Karas, Addison; Guy C. Richards, Crystal Lake; Earl R. Van Alsburg, Barrington, all of Ill.

[73] Assignee: American Can Company, Greenwich, Conn.

[21] Appl. No.: 68,179

[22] Filed: Aug. 20, 1979

[51] Int. Cl.[3] ..... B65D 8/08; B65D 25/14

[52] U.S. Cl. ..... 220/454; 206/509; 220/67; 220/70; 220/72; 220/458; 220/DIG. 22

[58] Field of Search ..... 220/66, 67, 70, 1 BC, 220/458, 454, DIG. 22, 72; 206/503, 509; 113/120 H

[56] References Cited

U.S. PATENT DOCUMENTS

| | | | |
|---|---|---|---|
| 2,339,763 | 1/1944 | Calleson et al. | 220/70 X |
| 2,950,839 | 8/1960 | Hahn | 220/458 X |
| 3,272,383 | 9/1966 | Harvey | 220/66 |
| 3,279,640 | 10/1966 | Dodson | 220/70 X |
| 4,054,227 | 10/1977 | Saunders | 220/458 |
| 4,120,419 | 10/1978 | Saunders | 220/1 BC X |
| 4,125,632 | 11/1978 | Vosti et al. | 220/70 X |

FOREIGN PATENT DOCUMENTS

| | | | |
|---|---|---|---|
| 400766 | 11/1933 | United Kingdom | 220/503 |
| 507580 | 12/1938 | United Kingdom | 220/66 |
| 1433983 | 4/1976 | United Kingdom | 220/70 |
| 1533057 | 11/1978 | United Kingdom | 220/458 |

*Primary Examiner*—Allan N. Shoap

*Attorney, Agent, or Firm*—Robert P. Auber; George P. Ziehmer; Stuart S. Bowie

[57] ABSTRACT

A bottom profile for a cylindrical two-piece drawn steel can is configured during manufacture so that the resultant shape may subsequently be altered by pushing downward at the outer profile ring adjacent the periphery with a simple cylindrical tool, thereby achieving a finished container with the desired configuration to be functionally and operationally interchangeable in a packing and processing line with traditional three-piece containers.

7 Claims, 10 Drawing Figures

CONTAINER SHAPE

BACKGROUND OF THE INVENTION

This invention relates to can ends and more particularly to the bottom end of a two-piece drawn steel food containing can which is designed to be processed at high temperature and pressure in a retort. More particularly, in a can where the contents are to be heated above their boiling point and then cooled, the bottom end is subjected to internal pressure and then external pressure. Each sealed container must be retorted to prevent bacterial growth and spoilage which will generate metabolic products such as organic acids and carbon dioxide; the latter inflates the sealed container causing it to bulge and become unseamed. In order to have commercial sterility (safety) the food must be heated to a state which renders it free of viable forms of micro-organisms which are there or which would reproduce in the future under normal storage conditions. A certain group of high acid foods need not be retort processed; these acidic foods are hot packed. That is to say, that they are heated to the boiling point and then packed in the container. The combination of the hot fill and the acid is equivalent to retort sterilization of low acid level foods. Foods with a pH level of 4.6 or higher must be retorted in order to achieve commercial sterility.

In the past it has been the practice to use heavy gauge high strength metal to resist the processing stresses in a double seamed on bottom end for a three-piece container e.g. 85 lbs per base box plate. In general, the three-piece container is less satisfactory because it costs more, it produces a needlessly heavy container, it is subject to seam leaks and it is wasteful of energy and resources. More process steps are necessary during the fabrication of a three-piece container. More particularly, such containers include on their ends a deep chuck countersink for strength and chuck clearance. Such a countersink is subject to buckling during processing. A two-piece can with an integral bottom does not require a bottom end chuck countersink for double seaming, but a bottom recess is necessary in order to manufacture a two-piece can with the same height and capacity as a conventional three-piece can so that either can be interchangeably used in the same packing and processing line. Profiling has been used to apply ribs, creases and the like to add rigidity to the bottom of a two-piece can. With only profiling, the pressurized two-piece can bottom may tend to distend and exceed the elastic limit of the metal. When that happens the can is unacceptable as it will rock about its distended bottom and appear to contain tainted or spoiled contents. Consequently, a bottom recess can improve the performance of thin-two-piece cans.

The large capital investments in equipment for handling three-piece cans cannot be merely written off. A two-piece container which will physically resemble the three-piece container is essential in order to permit continued use of the existing three-piece equipment, e.g., labelling, runways, retort, etc. The 100% interchangeability is recognized in the patent art, see, for example, U.S. Pat. No. 3,912,109 which discloses an approach and several methods of making same. Such prior art is typical in its emphasis on duplicating the shape of the three-piece can but fails to teach of a container which will protect food without corrosion. For economy and high-speed production a drawn two-piece can made of coil coated metal or subsequently coating a drawn and beaded container should be designed so that the interior coating remains intact even though the bottom is then deeply recessed and formed to include a chime-like bead to provide rolling in the trackwork and through the labeler and other food packing and processing equipment. In the prior art there is no teaching of a way to form a chime-like bead at the bottom of the can without damaging the inside coating surface. More particularly, the use of internal tools to form a chime-like bead is detrimental to the coating. In the present invention the forming is inwardly from the can exterior after the sidewall beading thereby preventing undue loading by the inside tools eliminating the danger of scuffing and sharp bends in reforming which would crack the inside coating.

Since drawn two-piece containers offer numerous advantages particularly in the elimination of the side seam and one end seam, it is commercially important that the bottom profile formed in accordance with the preferred method and shape also be able to withstand a retort temperature of 250° F. for thirty minutes or more, and yet be interchangeable in all respects with the three-piece container which may be used on the same package and processing line.

It is, therefore, an object of the present invention to provide a two-piece can bottom profile which is resistant to ultimate stress in excess of the elastic limit of the can material.

It is yet another object of the invention to provide a sidewall bead located at the very bottom of the can wall that will have an outer diameter essentially equal to outer diameter of the top double seam used to close the container after packing.

It is still another object of the present invention to provide a bottom profile and an adjacent bottom sidewall bead which will allow two-piece cans to be run interchangeably with conventional three-piece cans, such that the processing speed of the two types of containers can be essentially the same.

It is an object of the invention to provide a bottom profile and method for forming same which will not destroy the integrity of the coated interior.

It is a further object of this invention to provide a two-piece container of a low cost efficient light gauge coated metal which is capable of resisting buckling caused by heating pressures incurred during retort processing and cooling.

SUMMARY OF THE INVENTION

The profile design concept which permits the objects to be realized is found in a two-step forming system, where the first profiling is done at the completion of the final draw, in a draw/redraw press. At that stage the profile has all the essentials of the final desired profile except for the coated bottom recess or depth of the sidewall of the first profile indentation or the first valley as it is referred to sometimes. The drawn can bearing the primary profile shape is then sent to the beading machine, where the sidewall and bottom (or stacking) beads are applied to the can side wall. The bottom stacking bead is placed on the sidewall slightly above the plane of the bottom panel (usually centered about 0.160" above the plane of the can bottom) so that a beading mandrel placed inside the can does not scuff or scrape off the bottom interior coatings making the container vulnerable to corrosion. The now nearly completed can having only a relatively shallow bottom profile is transferred to a post forming machine (can flanger) where a cylindrical tool of the proper size and shape to bear upon the central panel inside the first profile inclination fitted with a flat shoulder which acts as a limit stop when the tool is pressed axially toward the can bottom from the outside causing the material in between the center of the bottom sidewall bead and the first bottom profile bead to roll down into the can. Such reformation by the tool leaves a new half-bead at the very bottom of the can a short flat bead extending toward the bottom center but merging into a relatively deep first profile valley defined by an inside sidewall. The central part of the newly formed recess retains the profile shape originally put into the can during the last redraw step.

The completed can has identical height and capacity when compared to a conventional three-piece can. Consequently, the same height label as used on a three-piece can is usable and similarly this two-piece can configuration will roll smoothly through any labeler and processing equipment or trackwork designed for three-piece containers due to the same rolling diameter at both ends. For purposes of high-speed production it is preferred that the metal from the two-piece can body be drawn from a precoated coil. More particularly, any drawable steel such as TFS-CT or ETP, the latter having from 10 to 135 pounds per base box of electrolytically deposited tin. The tinplate could be continuously cast, continuously annealed aluminum or silicon killed or rimmed and stabilized ingot cast steel. Steel thickness of 55 pounds per base box up to 85 pounds per base box with a temper of T-1 to T6 single reduced plate or double reduced plate of DR-7 through DR-9 could be used. The preferred embodiment is a DR-9 double reduced steel of the TFS-CT type. Such a material is precoated with an epoxy phenolic exterior (of can body) to prevent corrosion and an organosol interior (of can body) surface coating to protect the metal from the foods packed and processed in the container. The precoated metal is fed into a press in which it is cupped, drawn and redrawn into a can-like cylindrical shape having a side and integral bottom wall. The side being almost twice the diameter of the can body.

DETAILED DESCRIPTION OF THE DRAWINGS

Figure 1:
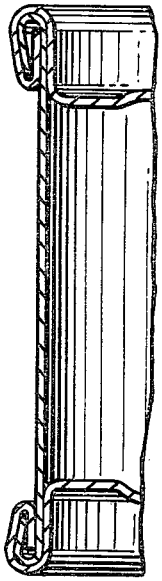
FIG. 1 is a partial cross-sectional elevational view of the prior art three-piece container.

FIG. 1 is a partial sectional elevational view of a prior art three-piece container. It is so designated because the container body forms a one-piece cylindrical shape seamed along a vertical side line and two substantially flat circular ends are double seamed onto the aforesaid body. In all, there are three seams which must be hermetic in order to provide the required commercial sterility.

Figure 2:
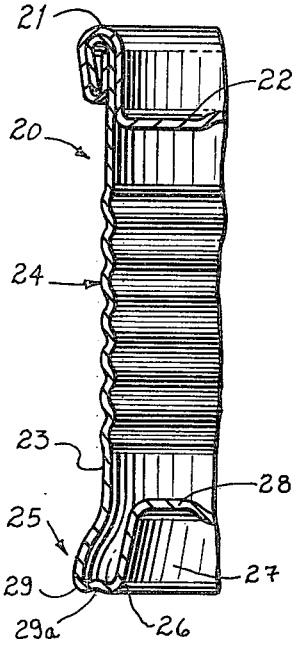
PRIOR ART FIG. 2
FIG. 2 is a partial cross-sectional elevational view of a two-piece container fashioned to be 100% interchangeable with the three-piece container of FIG. 1.

FIG. 2 shows an enlarged partial cross-sectional view in elevation of a two-piece container 20 composed of a cylindrical body designed to be double seamed with a circular and substantially planar end 22. The top portion of the rim of the double seam is 21. The two-piece container 20 of FIG. 2 includes a side wall 23 including beading 24 and lower chime-like bead 25. The invention herein pertains to the shape and formation of the lower chime-like bead 25. Extending normal to the side wall 23 and forming a bottom of the container is the final contoured bottom profile 26 which includes an inside axially disposed side wall 27 and a substantially flat central portion 28. Connected between the chime-like bead 25 and the bottom of the inside side wall 27 is a flat circular annular portion 29. Portion 29 includes a convolution **29*a* disposed intermediate the juncture of the chime-like bead 25 and the inside wall 27**.

Figure 3:
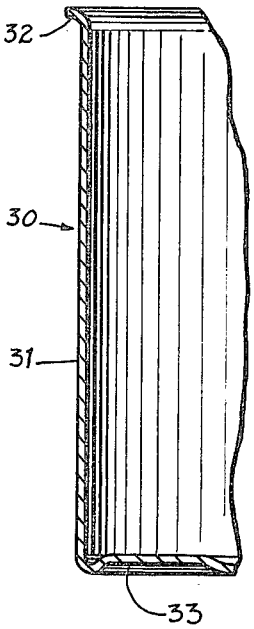
FIG. 3 is a partial cross-sectional elevational view of the preliminary configuration of the container as it is formed and bottom profiled on a draw/redraw press.

In order to understand the features of the preferred configuration and the method for making same a series of progressively shown container configurations are disclosed in FIGS. 3 through 10. More specifically, FIG. 3 is a partial fragmentary side cross-sectional view of the can body in elevation as it appears after it has been drawn and redrawn in a large metal forming press. The can body of FIG. 3 is labelled 30 and includes a side wall 31 which is substantially flat and smooth having an upper, outwardly extending normally disposed flange 32 and a substantially flat and planar integrally formed bottom 33. Only a portion of the container is shown. Those skilled in the art will appreciate that each of the containers shown are complete, circular and cylindrical whereby food and beverage can be packed in each without leakage. Along the inside surface of these cylindrical containers is a coating of a material such as an organosol and same is not shown in FIG. 3. The coating thickness is relative to the thickness of the can body metal practically invisible in the cross-sectional depictions such as those shown in the drawings herein, same is shown only as part of the inside edge. However, the coating is sufficient to prevent the food materials packed in the containers from attacking corrosively or otherwise the metal of which the container is formed. The container is drawn and redrawn of a preferred weight of 65 pound plate per base box of aluminum killed TFS-CT steel having a temper of DR-9. The resulting drawn and redrawn container 30 appears as shown in the partial fragmentary cross-sectional view of FIG. 3. The exterior surface of the container can also be coated but with an epoxy phenolic material which again is of a thickness so slight that a reasonable showing of it relative to the thickness of the 65 pound plate would be no more than the line or surface of the plate shown.

Figure 4:
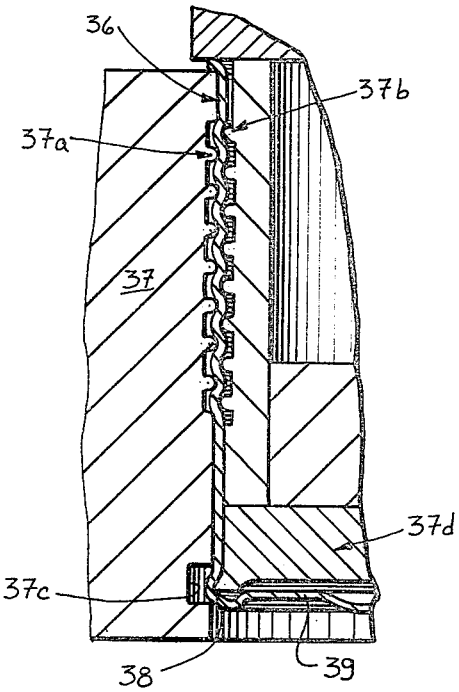
FIG. 4 is a partial cross-sectional elevational view of the container of FIG. 3, which has undergone a beading operation in the beading dies shown.
Figure 5:
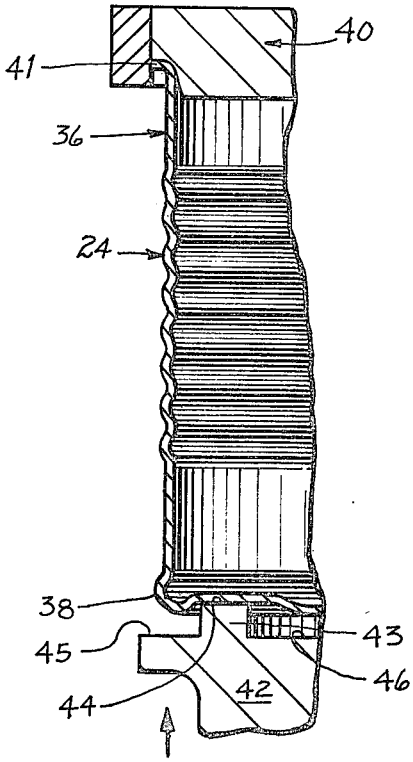
FIG. 5 is a partial cross-sectional view of the beaded container of FIG. 4 set up to be subjected to a post beading bottom profile reforming operation in a can flanger.

Turning now to FIG. 4, the container 30 of FIG. 3 is reformed along its side wall into a new container shape designated 36 by a beading die labelled 37, generally having an external die surface 37*a* and internal die surface 37*b* which cooperate by radial movement toward and away from one another to form a series of beads 24 (see FIGS. 2, 4 and 5). In addition to the series of beads 24, there is also a lower side wall stacking bead 38 shown in FIGS. 4 and 5 which is formed specifically by a lower outer beading die 37*c* and inner beading die 37*d* which are arranged to bulge the container bottom side wall outwardly relative to its container axis at a point just above the bottom plane 39 of the container 36 whereby its downwardly facing the bottom most adjacent inner beading die 37*d* clears the coated internal bottom surface of the bottom 39. Consequently, as the beading operation takes place during the radial movement of the die there is no contact between the bottom inner surface of 39 and the lowest most surface of the die adjacent to 37*d*.

FIG. 5 shows the beaded container 36 placed up against a can flanger die 40 for flange reforming whereby the flange 32 of FIGS. 3 and 4 is reformed into a more perpendicular and elongated flange 41 in a manner well known to those skilled in the art. The can flanger is shaped to bend flange 32 more outwardly and more normal to the side wall of the container 36. For the purpose of bringing pressure to bear upon the container and forcing the flange into its new shape in accordance with the configuration of the can flanger 40 there is an axially aligned circularly shaped tool 42 brought to bear against the exterior bottom 39 of the container 36, as shown by the arrow. The tool 42 is of a specific design and includes an upstanding annular rib 43 having an upper flat ring-like surface 44 and a depressed lower, outer shoulder 45 also of circular configuration and a recessed circular central section 46.

Figure 6:
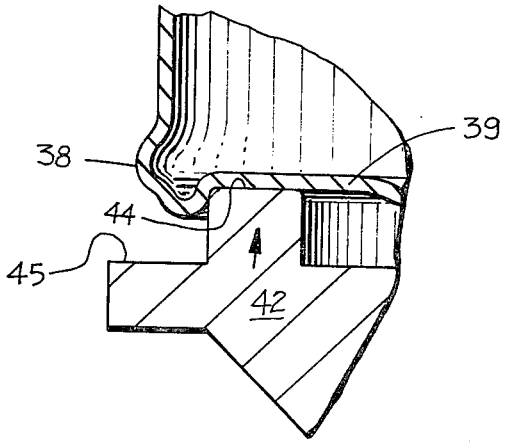
FIG. 6 is an enlarged partial cross-sectional fragmentary view of one intermediate step in the bottom reformation process.
Figure 7:
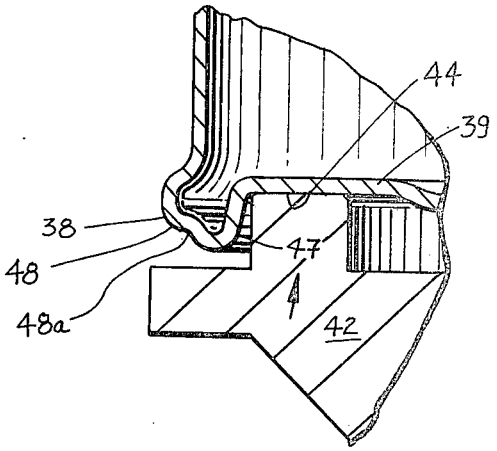
FIG. 7 is an enlarged partial cross-sectional fragmentary view of a further step in the reformation process.

FIG. 6 shows an enlarged partial fragmentary cross-sectional view of the tool 42 as it appears when the upper surface 44 is brought to bear upon the bottom 39 during can flanging. It will be noted that the lowest or stack bead 38 has its original configuration as applied by the beading dies 37*c* and *d* of FIG. 4. FIG. 7 is similar to FIG. 6. However, sufficient pressure has been applied to the tool 42 whereby the bottom 39 is moved inwardly by the face 44 of the tool 42 thus beginning to create the inside side wall 27 (shown in FIG. 2). The intermediate development of shape, the side wall 27 and the circular annular portion 29 are generally designated in FIG. 7 as 47 and 48 respectively and the convolution 29*a* is designated 48*a*. As shown in the reformation of the bottom 39 is a gentle process whereby the bending is more in the nature of rolling as opposed to creasing or folding. Consequently, the coated interior organosol 34 is flexed and stretched rather than creased and cracked.

Figure 8:
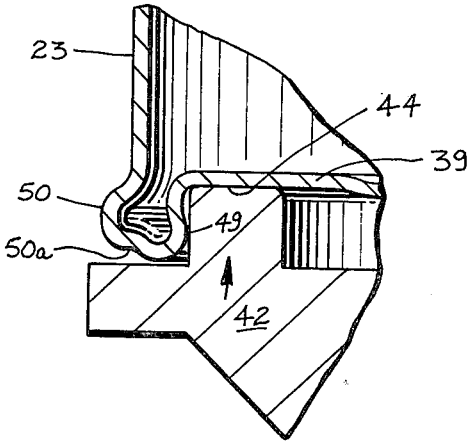
FIG. 8 is an enlarged partial cross-sectional fragmentary view of yet a still further step in the reformation process.

FIG. 8 discloses a still further step in the reformation of the bottom 39 by continued pressure applied at face 44 of tool 42. The juncture between the bottom 39 and the can side wall 23 has been further reformed whereby this intermediate stage of the inside side wall 27 formation is now designated 49 and the flat circular annular portion is designated 50 with its convolution 50*a*. Evident is the continued rolling inwardly and the slight reformation of the bottom 39 which is developing a central recessed section, the center of which is shown at 28 in FIG. 2.

Figure 9:
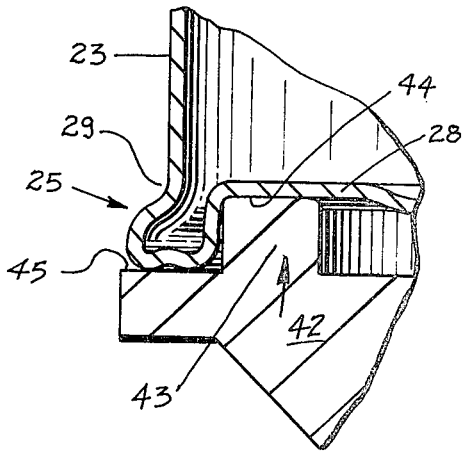
FIG. 9 is an enlarged partial cross-sectional fragmentary view of the final or complete reformation of the bottom profile.

FIG. 9 discloses the final position of the tool 42 wherein the face 44 has had sufficient pressure applied therethrough to the bottom of the container to fully develop or reform the bottom 39 into the configuration, shown in FIG. 2. The reformation is limited by the shoulder 45 which in its final position abuts the lowest most formed surface of the flat annular portion 29. Thus the depth of the inside side wall 27 is controlled by the relative outer height of the rib 43 as established by the position of the shoulder 45 relative to the face 44. FIG. 9 illustrates the appearance of the final form of the unfilled, unpacked and unprocessed container and shows how the bottom chime-like bead 25 is formed without damage to the interior coating by careful application of the tools so as to prevent scratching and scuffing which would destroy the integrity of the coating and permit attack to the metallic body by the chemicals in the food to be packed. No sharp internal creases or tooling damage result during the formation of the chime-like bead 25.

The chime-like bead 25 extends diametrically, a distance equal to the extension diametrically of the double seamed bead (see FIG. 2) whereby the container of FIG. 2 will roll in existing can trackwork in the same way as the container of the prior art shown in FIG. 1. In addition, the side wall 23 between the chime-like bead 25 and the double seam in FIG. 2 is of a length equal to that of the prior art three-piece can in FIG. 1 whereby this new two-piece container can be labeled and processed in the same machinery used for the three-piece container of FIG. 1. Therefore, in terms of equipment used for packaging and processing this new two-piece container is 100% interchangeable.

Figure 10:
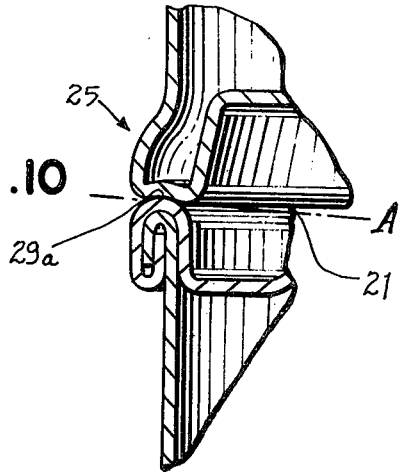
FIG. 10 is a partial fragmentary cross-sectional view of the completely reformed bottom profile of a filled and sealed container after restoring to illustrate the cooperation of its stacking feature when adjacent to the double seam of the top end of the can below it.

FIG. 10 shows not only the similarity of the diameters of the double seamed and the chime-like bead 25 but also discloses an additional feature of the reformed bottom corner or bead-like chime 25 of the container 20 and the ability to stack relative to a can beneath it. More particularly, in placing such containers after they are filled, sealed and processed in a carton or on a shelf in a super market, it is desirable, as the cans are stacked vertically along a central axis, not to shift relative to one another. A positive stacking feature is essential. This feature is provided by the conjugation of the convolution 29*a* and the uppermost portion 21 of the double seam. Concentricity of these conjugated portions 29 and 21 provides for interengaging mating when placed along a central axis. Because after the containers are completely processed in a retort or hot packed, the line of conjugation includes a slight downwardly and inwardly extending tilt as indicated by the straight line A shown in FIG. 10. A similar line, if placed in FIG. 9, on the unpacked and processed container would be normal to the side wall 23 and not have the slightly upwardly, outwardly tilt of line A. This change in configuration is a result of the pressures brought to bear upon the container during retort processing or hot fill which tend to expand the container and in this instance in a controlled fashion which results in a realignment of the bottom portion 29. Consequently, the mating engagement or stacking feature of containers placed along a common central axis is more secure as a result of the processing pressure reformation described.

While a particular two-piece container configuration is disclosed it is desired that the claims which follow will protect any configuration formed in a manner and by a method similar to the one described which gives the preferred function and operation.

What is claimed is:

1. In an improved two-piece metal can having a seamless container body of circular cross-section formed of a thin material into an integral side and bottom wall, a circular closure adapted to be joined to said side wall by an annular doubleseam having five adjacent layers of metal, the improvement wherein the profile of the area next adjacent the juncture of the side and bottom wall includes:

(a) an outwardly radial extending lower side wall portion forming a chime-like bead having its most distal extent near the bottom periphery, (b) a substantially flat circular ring-shaped section extending generally normal to said side wall portion and in-line with the bottom most plane of the container bottom, (c) an interior annular side wall extending into the container from the bottom most plane of said bottom and joining the inside edge of said ring-shaped section to a recessed central panel of said bottom, and (d) an annular convolution disposed substantially intermediate said bottom distal extent of said chime-like bead and said inside edge of said ring-shaped section, said convolution being located at said substantially flat circular ring-shaped section.

2. The can of claim 1 wherein the thin seamless container body is formed in a multiple drawing operation of a precoated metallic sheet, the coating being an organosol and the metal being a tin free steel of the chromium type.

3. The can of claim 1 wherein the seamless container body being formed of electrolytically deposited tinplate in a multiple drawing operation and thereafter coated.

4. The can of claim 1 wherein said annular convolution is adapted to cooperate with the central upper part of a doubleseam in mating engagement when the central axis of two cans of substantially similar diameter are aligned as during stacking.

5. The can of claim 4 wherein said circular ring-shaped section extending axially outwardly to a greater extent at said inside edge than the part thereof which connects to said side wall bottom periphery after the can has been packed and subjected to pressures resulting from hot filling or processing.

6. The can of claim 1 wherein said chime-like beading and said circular ring-shaped section form a relatively open inwardly can profile adapted for cooperatively assuring a continuous interior coating thereof.

7. The can of claim 1 wherein said distal extent of said bottom periphery is identical to the distal extent of said annular doubleseam after it is seamed hermetically to a closure applied to the top of the can.

* * * * *